United States Patent [19]

Sirotenko et al.

[11] Patent Number: 4,978,466

[45] Date of Patent: Dec. 18, 1990

[54] NON-COMBUSTIBLE LUBRICATING FLUID

[75] Inventors: Vadim A. Sirotenko; Eleonora V. Degtyareva; Yakov M. Grinberg; Efim I. Zaretsky; Vadim L. Yasnogorodsky; Andrei M. Khanin, all of Kharkov; Anatoly D. Kantemir, Kharkovskaya; Vladimir N. Tuz, Kharkov; Lidia P. Serezhkina; Moscow; Alla I. Gnilitskaya, Kharkov, all of U.S.S.R.

[73] Assignee: Proizvodstvennoe Obiedinenie Atomnogo Turbostroenia "Kharkov Sky Turbinny Zavod" Imeni S.M. Kirova

[21] Appl. No.: 490,623

[22] PCT Filed: Jul. 25, 1988

[86] PCT No.: PCT/SU88/00139

§ 371 Date: Mar. 19, 1990

§ 102(e) Date: Mar. 19, 1990

[87] PCT Pub. No.: WO90/01057

PCT Pub. Date: Feb. 8, 1990

[51] Int. Cl.[5] ..... C10M 173/02; C10M 149/06

[52] U.S. Cl. ..... 252/49.3; 252/49.5; 252/51.5 A; 252/51.5 R; 252/75

[58] Field of Search ..... 252/49.5, 49.3.51.5 A, 252/51.5 R, 75

[56] References Cited

U.S. PATENT DOCUMENTS 3,833,502 9/1974 Leary .
4,487,658 12/1984 Ciuti ..... 252/33.2
4,522,733 6/1985 Jonnes .
4,563,294 1/1986 Geymayer et al. ..... 252/49.3
4,728,452 3/1988 Hansen ..... 252/49.3
4,781,847 11/1988 Weitz ..... 252/49.3

FOREIGN PATENT DOCUMENTS 3123726 12/1982 Fed. Rep. of Germany .
3447421 6/1986 Fed. Rep. of Germany .
168826 10/1965 U.S.S.R. .

OTHER PUBLICATIONS

V. N. Kazansky, "Systemy Smazki Parovykh Turbin", 1974, Energiya Publishers, Moscow, pp. 9, 208–211.
K. I. Ivanov (Ed.), "Ognestoikie Turbinnye Masla", 1974, Khimiya Publishers, Moscow, pp. 20–22.

*Primary Examiner*—Jacqueline V. Howard
*Attorney, Agent, or Firm*—Ladas & Parry

[57] ABSTRACT

The present invention relates to non-combustible lubricating materials.

A non-combustible lubricating fluid is proposed, containing polyacrylamide, water, as well as triethanolamine and sodium nitrite, the ratio of the components being as follows, in % by mass:

| | |
|---|---|
| polyacrylamide | 0.3–0.6 |
| triethanolamine | 0.8–1.5 |
| sodium nitrite | 0.1–0.3 |
| water | the balance. |

1 Claim, No Drawings

NON-COMBUSTIBLE LUBRICATING FLUID

FIELD OF THE INVENTION

The invention relates to lubricating materials and, more particularly to a non-combustible lubricating fluid.

STATE OF THE ART

Lubrication of bearings in turbine and hydraulic turbo-machine control systems require the use of a lubricating fluid which ensures fluid friction with a preset thickness of the bearing fluid film between the rotary and stationary parts of the bearing, reduces the friction, and provides transmission of hydraulic pulses in devices of hydraulic turbo-machine control systems.

As said lubricating fluids mineral turbine oils are used in the world practice of operating turbo-machines (V. N. Kazansky, "Sistemy Smazki Parovykh Turbin", 1974, Energiya Publishers, Moscow, pp. 9, 208–211).

Mineral turbine oils, however, suffer from a serious disadvantage: they are fire-hazardous and cause fire accidents at electric power plants.

Also widely known in the art are non-combustible lubricating fluids based on water, including water itself. Water, however, has a low viscosity (1 cSt) and, as a result, the thickness of the bearing lubricating film in the hydrodynamic sliding-contact bearing proves to be insufficient for a reliable separation of the friction surfaces, which causes their increased wear and destruction.

Non-combustible lubricating fluids are known in the art, comprising water and polyglycols (K. I. Ivanov (ed.), "Ognestoikie Turbinnye Masla", 1974, Khimiya Publishers, Moscow, pp. 20–22). These fluids, however, are disadvantageous in that their viscosity at a preset temperature is not sufficiently stable in the course of time, so that they fail to provide stable operation of the turbo-machines. Polyglycols used in said lubricating fluids are very short-supply additives.

Also known in the art is a non-combustible lubricating fluid, comprising water and polyacrylamide (SU, A, 168826). However, the viscosity of this composition is also unstable in the course of time at a preset temperature. Furthermore, this fluid is very aggressive with respect to carbon steels which are the main structural materials in the manufacture of bearings for turbines, of hydraulic systems of turbo-machine control, and the like.

DISCLOSURE OF THE INVENTION

The invention is based on the problem of improving the stability in time of the temperature-viscosity characteristics of a non-combustible lubricating fluid, while reducing the aggressiveness thereof, by introducing novel components into the composition of said fluid and by changing the quantitative ratio of the components thereof.

This problem is solved by that a non-combustible lubricating fluid proposed herein, comprising polyacrylamide and water, according to the invention, also comprises triethanolamine and sodium nitrite, the ratio of the components being as follows (in % by mass):

| | |
|---|---|
| polyacrylamide | 0.3–0.6 |
| triethanolamine | 0.8–1.5 |
| sodium nitrite | 0.1–0.3 |
| water | the balance. |

The rate of corrosion of carbon steel under the effect of the prior art non-combustible lubricating fluid (SU, A, 168826) and under the effect of the herein-proposed non-combustible lubricating fluid, measured under similar conditions and with similar concentrations of polyacrylamide (0.4% by mass is 0.34 mm/year and 0.0021 mm/year, respectively. Thus, the non-combustible lubricating fluid proposed herein is appreciably less aggressive than said prior art non-combustible lubricating fluid.

The non-combustible lubricating fluid proposed herein has a viscosity whose time stability at a preset temperature is higher than that of the prior art lubricating fluid (SU, A, 168826).

The herein-proposed non-combustible lubricating fluid provides reliable operation of turbo-machines, it is explosion- and fire-safe, and no special measures of human protection are required when handling it.

BEST WAY OF CARRYING OUT THE INVENTION

If the ratio of the components of the herein-proposed lubricating fluid is changed, the reliability of the turbo-machine operation will be lowered.

The concentrations of polyacrylamide proposed herein are dictated by the fact that if the polyamide concentration is lower than the herein-specified, the viscosity required for the formation of a hydrodynamic lubricating layer having a sufficient thickness cannot be attained. If the polyamide concentration exceeds the herein-specified values, the viscosity will increase sharply, and the lubricating fluid will become technologically unfavourable.

If the concentration of triethanolamine and $NaNO_2$ is lower than the herein-specified values, the time stability of the temperature-viscosity characteristic of the non-combustible lubricating liquid is disrupted and the aggressiveness of the non-combustible lubricating fluid with respect to carbon steels increases. An increase in the content of triethanolamine and $NaNO_2$ above the values specified herein leads to a reduction of the viscosity of the lubricating fluid proposed in the present invention. To ensure the required viscosity, it would be necessary to introduce an additional quantity of polyacrylamide, this being economically unfavourable.

The polyacrylamide employed in the herein-proposed non-flammable lubricating fluid may be in the form of a gel (usually of a 8% concentration) or in the form of dry powder.

The herein-proposed lubricating fluid for turbo-machines is prepared in the following manner. Triethanolamine and sodium nitrite are introduced into water, the resulting mixture is stirred, polyacrylamide is then added thereto, and stirring is continued till the desired product is obtained.

For a better understanding of the present invention, examples illustrating its embodiments are given hereinbelow.

EXAMPLE 1

A non-combustible lubricating fluid according to the invention, comprising the following components, in % by mass:

| | |
|---|---|
| polyacrylamide | 0.3 |
| triethanolamine | 1.5 |
| sodium nitrite | 0.1 |
| water | 98.1 |

The non-combustible lubricating fluid of the invention for radial bearings of 420 mm in diameter was prepared in the following manner.

Three tons of water were charged into a vessel, 55.5 kg of triethanolamine and 3.7 kg of sodium nitrite were then added thereto, the contents were stirred, 72 kg of a 8% gel or 5.8 kg of dry powder of polyacrylamide were then added thereto, the resulting mixture was again stirred till the desired product was obtained.

The results of tests of the herein-proposed lubricating fluid, residing in measuring its kinematic viscosity in the working range of its service temperatures (25°, 50°, 70° C.) after passing the fluid through a bearing for 10, 20, 30, and 40 days are presented in the Table hereinbelow.

EXAMPLE 2

A non-combustible lubricating fluid according to the invention, comprising the following components, in % by mass:

| | |
|---|---|
| polyacrylamide | 0.6 |
| triethanolamine | 0.8 |
| sodium nitrite | 0.1 |
| water | 98.5 |

The herein-proposed non-combustible lubricating fluid was prepared and tested as described in Example 1. The results of the tests are presented in the Table hereinbelow.

EXAMPLE 3

A non-combustible lubricating fluid according to the invention, comprising the following components, in % by mass:

| | |
|---|---|
| polyacrylamide | 0.6 |
| triethanolamine | 0.8 |
| sodium nitrite | 0.3 |
| water | 98.3 |

The herein-proposed non-combustible lubricating fluid was prepared and tested as described in Example 1.

The results of the tests are presented in the Table hereinbelow.

EXAMPLE 4

A non-combustible lubricating fluid according to the invention, comprising the following components, in % by mass:

| | |
|---|---|
| polyacrylamide | 0.5 |
| triethanolamine | 1.0 |
| sodium nitrite | 0.2 |
| water | 99.3 |

The herein-proposed non-combustible lubricating fluid was prepared and tested as described in Example 1. The results of the tests are presented in the Table hereinbelow.

TABLE

| Nos 1 | Number of days during which the lubricating fluid was passed through the bearing 2 | Kinematic viscosity 25° C. 3 | 45° C. 4 | 50° C. 5 | 70° C. 6 | Test results 7 |
|---|---|---|---|---|---|---|
| 1 | 0 | 16.24 | 11.85 | 9.52 | 6.32 | No changes in the state of the surface of the bearing or journal |
| | 10 | 16.21 | 11.72 | 9.55 | 6.30 | |
| | 20 | 16.30 | 11.78 | 9.50 | 6.35 | |
| | 30 | 16.20 | 11.80 | 9.51 | 6.34 | |
| | 40 | 16.19 | 11.97 | 9.54 | 6.30 | |
| 2 | 0 | 19.13 | 13.28 | 10.25 | 7.12 | No changes in the state of the surface of the bearing or journal |
| | 10 | 19.00 | 13.21 | 10.15 | 7.00 | |
| | 20 | 19.25 | 13.31 | 10.27 | 7.15 | |
| | 30 | 19.15 | 13.24 | 10.27 | 7.10 | |
| | 40 | 19.17 | 13.20 | 10.25 | 7.07 | |
| 3 | 0 | 16.97 | 12.01 | 9.70 | 6.65 | No changes in the state of the surface of the bearing or journal |
| | 10 | 16.94 | 12.10 | 9.72 | 6.68 | |
| | 20 | 16.92 | 12.08 | 9.67 | 6.70 | |
| | 30 | 17.00 | 12.12 | 9.78 | 6.73 | |
| | 40 | 17.01 | 12.13 | 9.81 | 6.75 | |
| 4 | 0 | 19.61 | 14.39 | 11.53 | 7.85 | No changes in the state of the surface of the bearing or journal |
| | 10 | 19.65 | 14.38 | 11.58 | 7.95 | |
| | 20 | 19.59 | 14.40 | 11.55 | 7.81 | |
| | 30 | 19.63 | 14.43 | 11.52 | 7.84 | |
| | 40 | 19.60 | 14.41 | 11.50 | 7.82 | |
| | Prior art non-combustible lubricating fluid (SU, A, 168826) | | | | | |
| | 0 | 13.21 | 7.75 | 5.63 | 2.81 | Attrition of the babbit surface. Tests are |
| | 10 | 12.46 | 7.10 | 5.13 | 2.43 | |
| | 20 | 11.00 | 6.92 | 4.85 | 2.11 | |

TABLE-continued

| Nos 1 | Number of days during which the lubricating fluid was passed through the bearing 2 | Kinematic viscosity 25° C. 3 | 45° C. 4 | 50° C. 5 | 70° C. 6 | Test results 7 |
|---|---|---|---|---|---|---|
| | | | | | | stopped. |

INDUSTRIAL APPLICABILITY

The present invention may find application in the field of lubricating materials for bearings used in turbo-machines and for hydraulic systems of turbo-machine control, as well as for other similar units.

We claim:

1. A non-combustible lubricating fluid comprising polyacrylamide and water, characterized in that it also comprises triethanolamine and sodium nitrite, the ratio of the components being as follows, in % by mass:

| | |
|---|---|
| polyacrylamide | 0.3–0.6 |
| triethanolamine | 0.8–1.5 |
| sodium nitrite | 0.1–0.3 |
| water | the balance. |

* * * * *